US006663218B2

(12) United States Patent
Uchida

(10) Patent No.: US 6,663,218 B2
(45) Date of Patent: Dec. 16, 2003

(54) HEAD RECOVERY DEVICE, HEAD RECOVERY METHOD AND INK JET RECORDING APPARATUS

(75) Inventor: Haruo Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 09/965,836

(22) Filed: Oct. 1, 2001

(65) Prior Publication Data

US 2002/0047874 A1 Apr. 25, 2002

(30) Foreign Application Priority Data

Oct. 4, 2000 (JP) ..... 2000-304941

(51) Int. Cl.[7] ..... B41J 2/165
(52) U.S. Cl. ..... 347/29; 347/22; 347/33
(58) Field of Search ..... 347/22, 29, 31, 347/32, 33, 34, 35, 36

(56) References Cited

U.S. PATENT DOCUMENTS

| | | | | |
|---|---|---|---|---|
| 6,017,110 A | | 1/2000 | Jackson | 347/33 |
| 6,062,672 A | * | 5/2000 | Ishize et al. | 347/30 |
| 6,158,838 A | * | 12/2000 | Capurso | 347/28 |

FOREIGN PATENT DOCUMENTS

| | | |
|---|---|---|
| EP | 0 465 260 | 1/1992 |
| EP | 0 676 290 | 10/1995 |
| JP | 7-16463 | 6/1995 |
| JP | 7-314732 | 12/1995 |
| JP | 9-1832 | 1/1997 |
| JP | 2001-54949 | 2/2001 |

OTHER PUBLICATIONS

EP Search Report dated Jan. 11, 2002.
U.S. Application No. 08/442,769, filed May 17, 1995.
U.S. Application No. 09/968,792, filed Oct. 3, 2001.

* cited by examiner

*Primary Examiner*—Stephen D. Meier
*Assistant Examiner*—An H. Do
(74) *Attorney, Agent, or Firm*—Fitzpatrick, Cella, Harper & Scinto

(57) ABSTRACT

The present invention provides a head recovery device of an ink jet recording apparatus having a pigment discharge port for discharging pigment ink and a dye ink discharge port for discharging dye ink, which recovery device includes a pigment ink cleaning member capable of abutting against a pigment ink discharge port face in which the pigment ink discharge port is provided to effect cleaning of such a face, and a dye ink cleaning member capable of abutting against a dye ink discharge port face in which the dye ink discharge port is provided to effect cleaning of such a face, and is characterized in that, in a predetermined recovery operation, the dye ink discharged from the dye ink discharge port is applied to the pigment ink cleaning member.

27 Claims, 12 Drawing Sheets

HEAD RECOVERY DEVICE, HEAD RECOVERY METHOD AND INK JET RECORDING APPARATUS

BACKGROUND OF THE INVENTION

1. Field of the Invention

The present invention relates to a head recovery device and a head recovery method for recording means having a pigment ink discharge port for discharging pigment ink and a dye ink discharge port for discharging dye ink, and an ink jet recording apparatus for effecting recovery of such a head.

2. Related Background Art

Recording apparatus having a printer, copier or facsimile function or recording apparatuses used as a composite electronic equipment including a computer or a word processor or as an output device such as a work station serve to record an image (including a character and/or a symbol) on a recording material (recording medium) such as a paper, cloth, a plastic sheet or an OHP sheet on the basis of recording information. Among them, a recording apparatus of ink jet type (ink jet recording apparatus) serves to effect recording by discharging ink from recording means (recording head) and has advantages that the recording means can easily made compact, that a highly fine image can be recorded at a high speed, that the recording can be effected without requiring special treatment of a plain paper, that a running cost is cheap, that there is less noise due to non-impact printing and that a color image can easily be recorded by using many kinds of inks (for example, color inks).

As an energy generating element for generating energy utilized to discharge ink from a discharge port of an ink jet recording head, there is an element utilizing an electromechanical converting member such as a piezo-electric element, an element in which heat is generated by illumination of an electromagnetic wave such as laser and an ink droplet is discharged by such a heating action or an element in which liquid is heated by an electrothermal converting member having a heat generating resistance body. Among them, in the recording means (recording heads) of ink jet type for discharging the ink as a droplet by utilizing thermal energy, recording having a high resolving power can be realized since the discharge ports can be arranged with high density. Particularly among them, a recording head using the electrothermal converting element as the energy generating element is particularly advantageous, since it can easily be made compact, merits of an IC technique or a microworking technique reliability of which has remarkably been enhanced in a recent semiconductor field can be well utilized, and high density mounting thereof is easy and a manufacturing cost thereof is inexpensive.

Further, many kinds of materials for the recording medium have been requested, and, in recent years, development for such requirement has been progressed, and some recording apparatuses can utilize cloth, leather non-woven fabric or metal as the recording material, as well as a paper (including thin paper and treated paper) and a thin resin plate (OHP sheet and the like) as normal recording material.

The recording apparatuses are generally grouped into a recording apparatus of serial type in which the recording is effected while performing main scanning in a direction perpendicular to a conveying direction of the recording paper (recording material) and a recording apparatus of line type in which the recording is effected by using a recording head having a predetermined length and held at a predetermined position to cover a range of a predetermined width (including whole width) in a width-wise direction of the recording paper. The present invention can be applied to any type of recording apparatus including such serial and line types. In the ink jet recording apparatus of serial type, normally, after the recording paper is set at a predetermined recording position, an image (including character and/or symbol) is recorded by the recording head mounted on a carriage shifting along the recording paper, and then predetermined amount paper feed (sub scanning) is effected, and, by repeating such operations, the entire image is formed on the recording paper.

In the above-mentioned ink jet recording apparatus, foreign matters such as ink droplets, debris, dirt and/or paper powder may be adhered to a head face of the recording head during the recording operation, and, thus, the head face is cleaned (for example, sliding swept) by a cleaning member to remove such foreign matters. Normally, a flexible member such as a rubber blade made of rubber elastic material is used as the cleaning member. Further, the ink near the discharge port may be dried to clog the discharge port due to increase in viscosity of ink and solidification and/or deposition of ink. Further, the discharge port may be clogged by a bubble and/or dirt generated within the interior of the discharge port (liquid path). As a method for recovering (prevention or elimination) such clogging, for example, a suction recovery method in which a sealingly closed system is formed around an ink discharge port portion by using a capping member and the ink is forcibly discharged from the discharge port by generating a negative suction force at the discharge port face (head face) by using a pump is adopted. Further, in order to remove the ink adhered to the head face by the suction recovery, the head face is cleaned (swept) by the cleaning member.

Now, a conventional head recovery device, head recovery method and ink jet recording apparatus in which head recovery is effected will be explained with reference to FIGS. 13 and 14.

FIG. 13 is a schematic front view of a head recovery device of a conventional ink jet recording apparatus, looked at from a forward direction, and FIG. 14 is a schematic side view of the head recovery device of FIG. 13, looked at from a side direction. In FIGS. 13 and 14, a black head (pigment ink head) 1A serves to discharge black pigment ink, a color head (dye ink head) 1B serves to discharge color (for example, cyan, magenta and yellow) dye inks, a main scanning carriage 2 serves to position and hold the black head 1A and the color head 1B, and main scanning rails 3 serve to guide and hold the main scanning carriage 2 for a reciprocal shifting movement in a direction A as a recording direction.

Further, a rubber cap (pigment ink head cap) 4A serves to form (cap) a sealingly closed system at a discharge port portion 1Aa of the black head 1A, and a rubber cap (dye ink head cap) 4B serves to form (cap) a sealingly closed system at a discharge port portion 1Ba of the color head 1B. These rubber caps 4A, 4B are positioned and held by a holder member (not shown) for shifting movements in a capping direction (shown by the arrow B) and a non-capping direction (shown by the arrow C) by means of driving sources (not shown), thereby constituting pigment ink head capping means and dye ink head capping means.

In FIGS. 13 and 14, cap absorption members 9A, 9B for absorbing and holding ink are disposed within the rubber caps 4A, 4B, respectively. Further, in order to prevent adhesion and deposition of viscosity-increased ink on the discharge port portions 1Aa, 1Ba, even during recording (print), preliminary discharge from the discharge ports is effected toward the cap absorption members 9A, 9B at a predetermined time interval. A black head (pigment ink head) suction pump (suction means) 5A and a color head (dye ink head) suction pump (suction means) 5B serve to effect suction recovery (recovery treatment) in which predetermined suction pressure (negative pressure) is generated at the discharge port portions 1Aa, 1Ba in a capping condition thereby to forcibly suck the ink from the discharge port portions 1Aa, 1Ba through first tubes 6A, 6B and to discharge the sucked ink to a waste ink treating member 8 through second tubes 7A, 7B. A black head (pigment ink head) cleaning member 10A and a color head (dye ink head) cleaning member 10B are formed from rubber material such as urethane, butyl or silicone, or porous sponge material.

The cleaning members 10A, 10B can be shifted in directions shown by the arrows D, E by means of driving sources (not shown), so that, when shifted in the direction D, these members slide on the head face including the discharge port portions 1Aa, 1Ba (broken line positions (1)→(2)→(3)), thereby effecting cleaning (sweeping cleaning). After the cleaning is finished, when the members are further shifted in the direction D, the cleaning members 10A, 10B abut against cleaners 11A, 11B (broken line position (4)). Due to such abutment, foreign matters such as ink droplet, debris, dirt and/or paper powder removed from the head face and adhered to the cleaning members 10A, 10B are transferred (transported) to the cleaners 11A, 11B for collection. In this case, the caps 4A, 4B of the capping means are shifted (retarded) in the direction C by the driving sources (not shown) to be retarded to positions where they do not interfere with the cleaning members 10A, 10B.

However, in the above-mentioned conventional head recovery device, head recovery method and ink jet recording apparatus for effecting such head recovery, although there is no problem regarding endurance of various parts of the apparatus when the ink of dye group (dye ink) is used, when the ink of pigment group (pigment ink) is used, since an elapsed time until the ink is viscosity-increased or solidified is shorter than that of the dye ink (i.e., prematurely viscosity-increased or solidified) and since cleaning ability for scraping (or sweeping) the ink by means of the cleaning member is worse than that when the dye ink is used, even if the cleaning is effected by sliding the cleaning member against the head face of the recording means, the ink will remain on the head face as a thin film and such ink be solidified, with the result that it is very hard to achieve the head recovery by the cleaning operation. Further, also when the ink scraped from the head face and adhered to the sliding portion of the cleaning member is collected in the cleaner, the ink cannot be collected in the cleaner completely, but remains on the cleaning member, and, since the remaining ink is solidified, the cleaning ability is worsened, thereby further progressing (worsening) the deposition of ink on the head face.

Due to such phenomena, depending upon the recovery operation in the ink jet recording apparatus, it will be very hard or impossible to the recover the pigment ink head thereby to reduce the service life of the pigment ink head, thereby causing a technical problem that the running cost is increased when the recording (print) is effected by using the pigment ink. Further, to avoid this, although it is considered that the cleaning is effected while supplying dissolving liquid for dissolving the pigment ink adhered to the cleaning member, in this case, the entire apparatus is made more bulky and the cost is increased.

SUMMARY OF THE INVENTION

An object of the present invention is to provide a head recovery device, head recovery method and ink jet recording apparatus, in which solidified and deposited pigment ink can be removed easily and positively by dissolving the pigment ink solidified and deposited on a pigment ink discharge port face (head face) and/or pigment ink discharge port cleaning means by means of dye ink.

Another object of the present invention is to provide a head recovery device of an ink jet recording apparatus having a pigment discharge port for discharging pigment ink and a dye ink discharge port for discharging dye ink, which recovery device comprises a pigment ink cleaning member capable of abutting against a pigment ink discharge port face in which the pigment ink discharge port is provided to effect cleaning of such a face, and a dye ink cleaning member capable of abutting against a dye ink discharge port face in which the dye ink discharge port is provided to effect cleaning of such a face, and is characterized in that, in a predetermined recovery operation, the dye ink discharged from the dye ink discharge port is applied to the pigment ink cleaning member.

A further object of the present invention is to provide a head recovery device of an ink jet recording apparatus having a pigment discharge port for discharging pigment ink and a dye ink discharge port for discharging dye ink, which recovery device comprises a pigment ink cleaning member capable of abutting against a pigment ink discharge port face in which the pigment ink discharge port is provided to effect cleaning of such a face, and a dye ink cleaning member capable of abutting against a dye ink discharge port face in which the dye ink discharge port is provided to effect cleaning of such a face, and is characterized in that, in a predetermined recovery operation, the pigment ink discharge port face is cleaned by at least one of the pigment ink cleaning member and the dye ink cleaning member, to which the dye ink discharged from the dye ink discharge port is applied.

A still further object of the present invention is to provide an ink jet recording apparatus having a pigment discharge port for discharging pigment ink and a dye ink discharge port for discharging dye ink and comprising a pigment ink cleaning member capable of abutting against a pigment ink discharge port face in which the pigment ink discharge port is provided to effect cleaning of such a face, and a dye ink cleaning member capable of abutting against a dye ink discharge port face in which the dye ink discharge port is provided to effect cleaning of such a face, and wherein, in a predetermined recovery operation, the dye ink discharged from the dye ink discharge port is applied to the pigment ink cleaning member.

A further object of the present invention is to provide an ink jet recording apparatus having a pigment discharge port for discharging pigment ink and a dye ink discharge port for discharging dye ink and comprising a pigment ink cleaning member capable of abutting against a pigment ink discharge port face in which the pigment ink discharge port is provided to effect cleaning of such a face, and a dye ink cleaning member capable of abutting against a dye ink discharge port face in which the dye ink discharge port is provided to effect cleaning of such a face, and wherein, in a predetermined recovery operation, the pigment ink discharge port face is cleaned by at least one of the pigment ink cleaning member and the dye ink cleaning member, to which the dye ink discharged from the dye ink discharge port is applied.

A still further object of the present invention is to provide a head recovery method in an ink jet recording apparatus having a pigment discharge port for discharging pigment ink and a dye ink discharge port for discharging dye ink, comprising the steps of abutting a pigment ink cleaning member against a pigment ink discharge port face in which the pigment ink discharge port is provided to effect cleaning of such a face, abutting a dye ink cleaning member against a dye ink discharge port face in which the dye ink discharge port is provided to effect cleaning of such a face, and applying the dye ink discharged from the dye ink discharge port to the pigment ink cleaning member.

The other object of the present invention is to provide a head recovery method in an ink jet recording apparatus having a pigment discharge port for discharging pigment ink and a dye ink discharge port for discharging dye ink, comprising the steps of abutting a pigment ink cleaning member against a pigment ink discharge port face in which the pigment ink discharge port is provided to effect cleaning of such a face, abutting a dye ink cleaning member against a dye ink discharge port face in which the dye ink discharge port is provided to effect cleaning of such a face, applying the dye ink discharged from the dye ink discharge port to at least one of the pigment ink cleaning member and the dye ink cleaning member, and cleaning the pigment ink discharge face by the cleaning member to which the dye ink was applied.

According to the present invention, by dissolving the pigment ink solidified and deposited on the pigment discharge port cleaning means and the discharge port face including the pigment ink discharge port by means of the dye ink, a head recovery device, head recovery method and ink jet recording head, in which the solidified and deposited pigment ink can be removed easily and positively, can be provided.

DETAILED DESCRIPTION OF THE PREFERRED EMBODIMENTS

Figure 1:
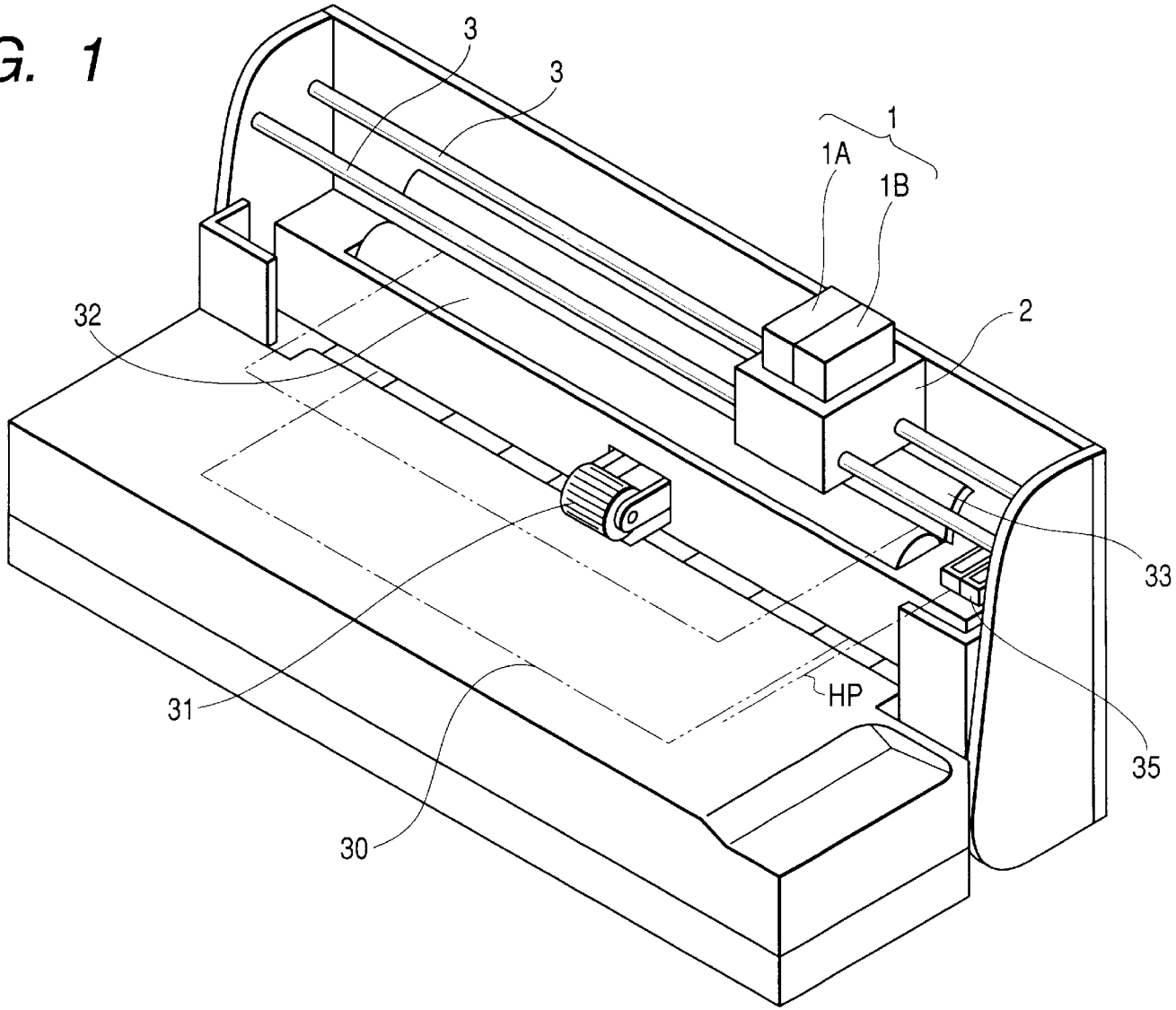
FIG. 1 is a schematic perspective view showing a schematic construction of an ink jet recording apparatus to which the present invention is applied.

The present invention will now be explained in connection with embodiments thereof with reference to the accompanying drawings. FIG. 1 is a schematic perspective view showing a schematic construction of an ink jet recording apparatus to which the present invention is applied. In FIG. 1, a pigment ink head (for example, black head) 1A for discharging pigment ink (for example, black pigment ink) and a dye ink head (for example, color head) 1B for discharging dye ink (color dye ink such as cyan, magenta and yellow) are positioned and mounted on a main scanning carriage 2, and the main scanning carriage is guided and supported by main scanning rails 3 for a reciprocal shifting movement so that the carriage is reciprocally driven by a driving source (not shown) in a main scanning direction (direction of the main scanning rails 3).

A recording material 30 such as a recording paper is sent into a main body of the apparatus by means of a sheet feeding roller 31 and is pinched between a sheet feed roller (conveying roller) 32, and a pinch roller (not shown) and a paper pressing plate 33. The recording material is fed (conveyed) through a position (recording position) spaced apart, by a predetermined gap, from a front face (a head face as an underside surface, in the illustrated embodiment) of recording means (recording head) 1 constituted by the pigment ink head 1A and the dye ink head 1B by controlling rotation of the sheet feed roller 32; meanwhile, an image (including characters and the like) is recorded (printed) by driving the recording head 1 in response to recording information. Within a shifting range of the main scanning carriage 2, at a position (right end of FIG. 1) out of the recording area, a home position HP for the main scanning carriage 2 is set.

In the vicinity of the home position HP, there is provided a head recovery device 35 comprising capping means having caps 4A, 4B made of rubber elastic material and capable of abutting against (sealingly contacting with) the head faces (in which the discharge ports are formed) of the pigment ink head 1A and the dye ink head 1B to seal the discharge ports, suction means including suction pumps capable of generating negative suction forces within the discharge ports through the caps 4A, 4B in a capping condition, and cleaning means including cleaning members slidingly contacting with the head faces of the pigment ink head 1A and the dye ink head 1B to remove (scrape or sweep) adhered foreign matters such as ink, dirt and the like. The head recovery device 35 serves to perform a recovery operation for recovering the discharging performance of the heads by generating negative pressure in the caps in a condition that discharge port portions of the heads are capped and by sucking and removing foreign matters such as viscosity-increased ink, bubbles, solidified ink, dirt and the like together with the ink from the discharge port by the negative pressure.

The pigment ink head 1A and the dye ink head 1B as the recording means (recording head) 1 are ink jet recording heads for discharging the ink by utilizing thermal energy and having electrothermal converting elements for generating the thermal energy. Further, the recording means (pigment ink head 1A and dye ink head 1B) serves to effect the recording (print including printing) by causing film boiling in the ink by means of the thermal energy supplied from the electrothermal converting element and by discharging the ink from the discharge port by utilizing change in pressure due to growth and contraction of a bubble generated by the film boiling.

Figure 2:
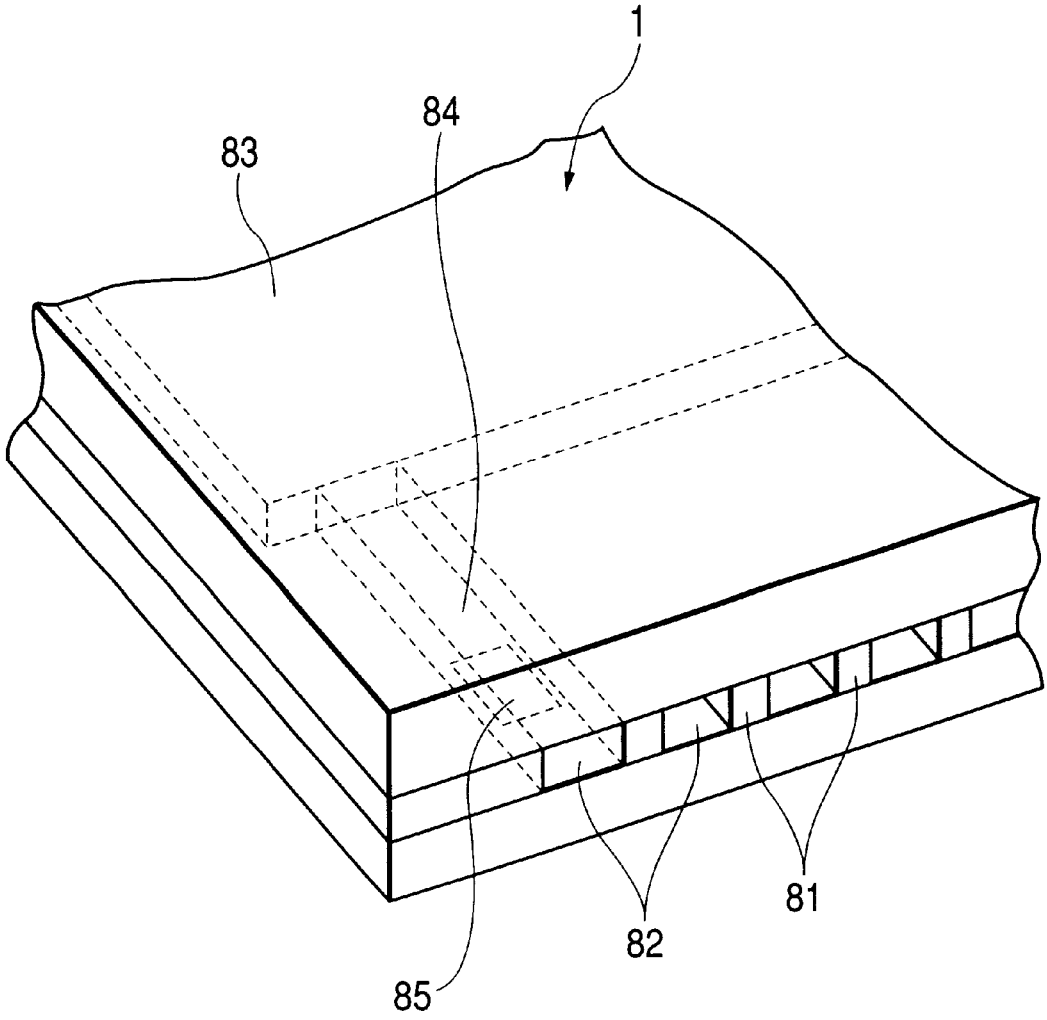
FIG. 2 is a partial perspective view schematically showing a structure of an ink discharge portion of a recording head of FIG. 1.

FIG. 2 is a partial perspective view showing a schematic structure of the ink discharge portion of the recording head 1. In FIG. 2, a discharge port surface 81 opposed to the recording material 30 with a predetermined gap (for example, about 0.2 mm to about 2.0 mm) therebetween is provided with a plurality of discharge ports 82 (corresponding to discharge ports 1Aa, 1Ba which will be described later) formed therein with a predetermined pitch, and an electrothermal converting element (heat generating resistance body) 85 for generating ink discharging energy is disposed along a wall surface of each of liquid paths 84 communicating between a common liquid chamber 83 and the respective discharge ports 82. The recording head 1 is mounted on the main scanning carriage 2 in such a manner that the discharge ports 82 are arranged side by side along a direction perpendicular to a main scanning direction (reciprocal shifting directions of the recording head 1). In this way, the recording head (pigment ink head 1A and dye ink head 1B) is constituted in such a manner that the corresponding electrothermal converting element 85 is driven (energized) in response to an image signal or a discharge signal to cause the film boiling in the ink in the corresponding liquid path 84 and the ink is discharged from the corresponding discharge port 82 by the pressure generated by such film boiling.

Figure 3:
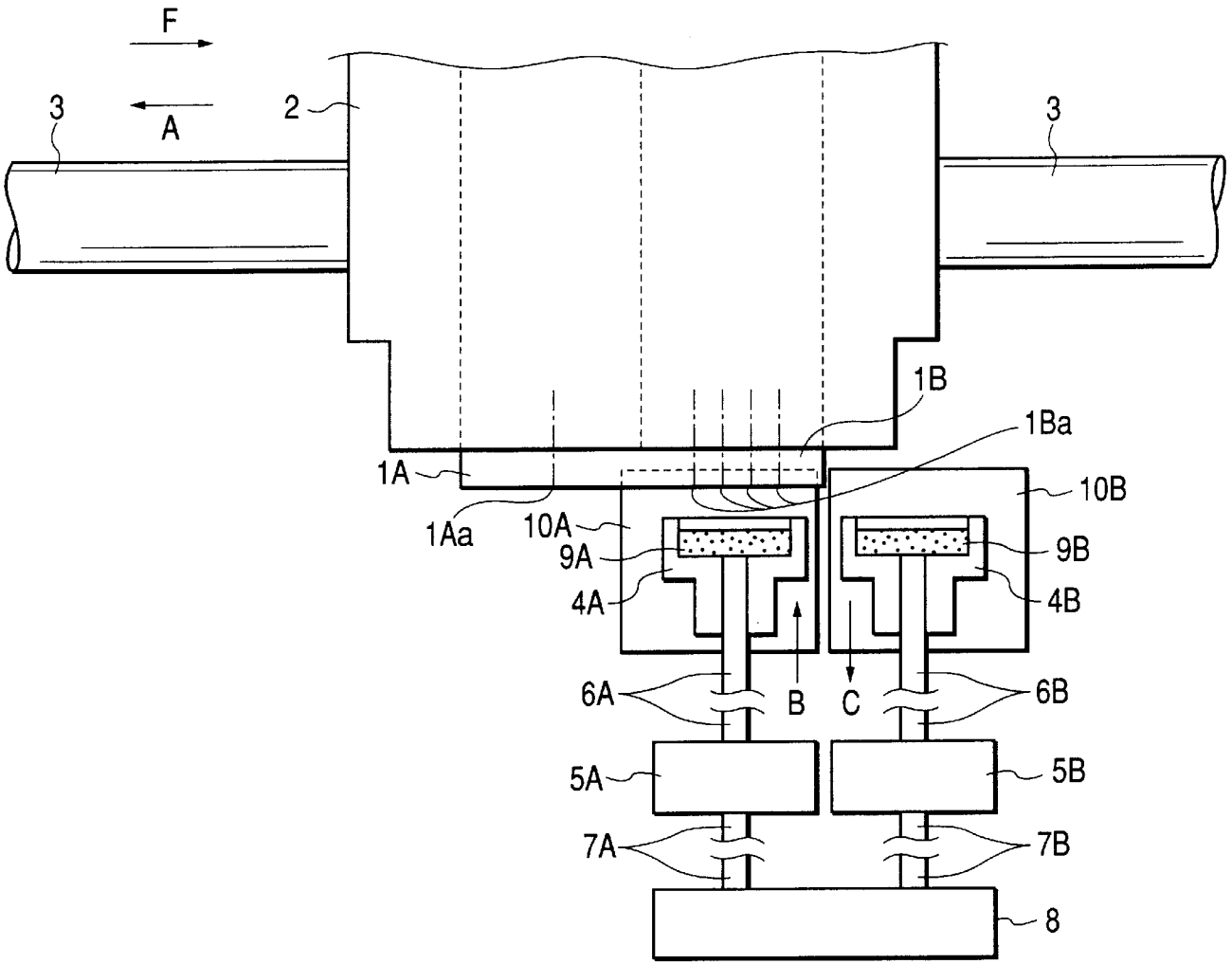
FIG. 3 is a schematic front view showing a non-capping condition in which a dye ink head (dye ink discharge port) is opposed to a pigment ink head (pigment ink discharge port) cap in an embodiment of a head recovery device of an ink jet recording apparatus to which the present invention is applied.
Figure 4:
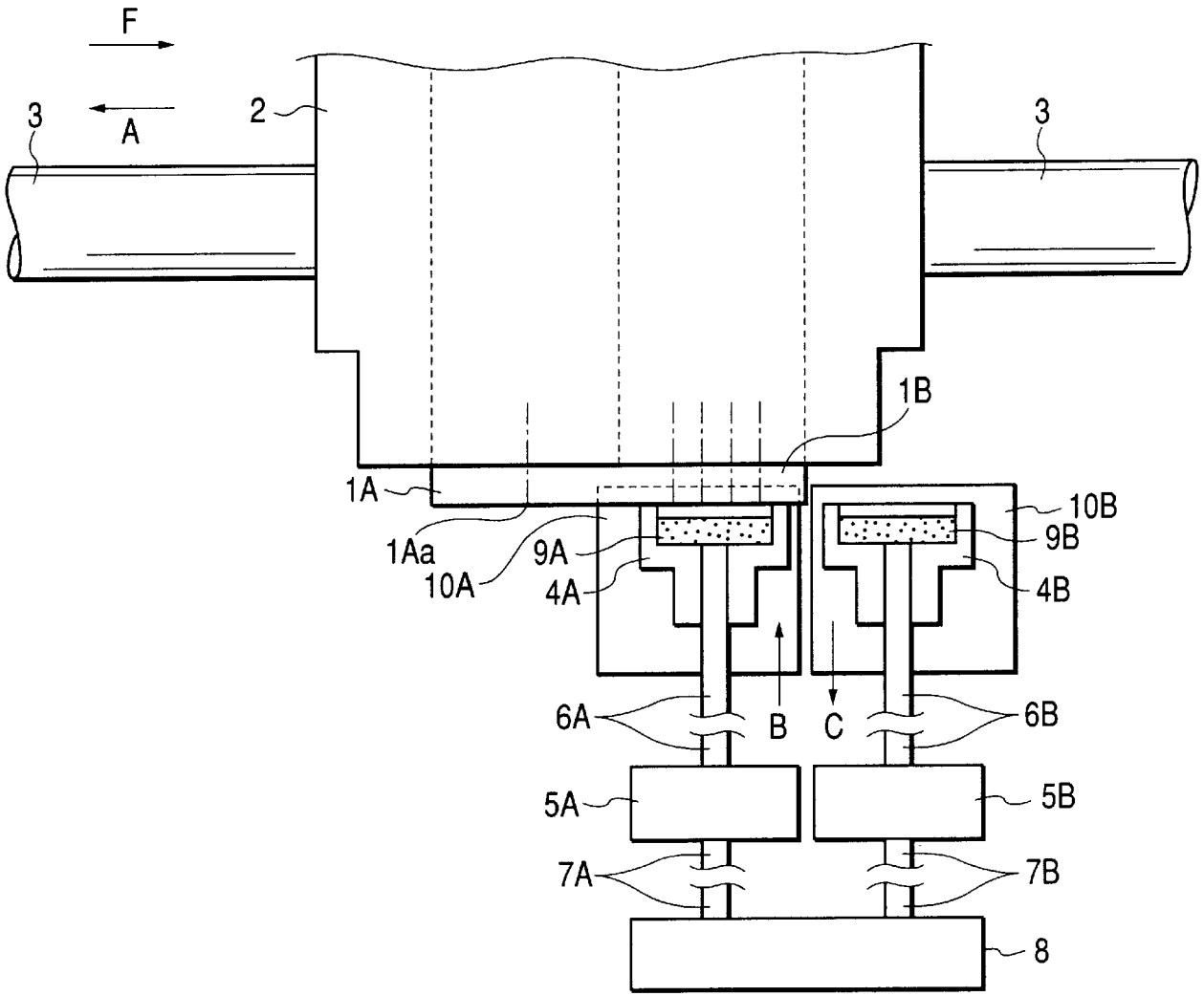
FIG. 4 is a schematic front view showing a capping condition in which the dye ink head is opposed to the pigment ink head cap in the recovery device of FIG. 3.
Figure 5:
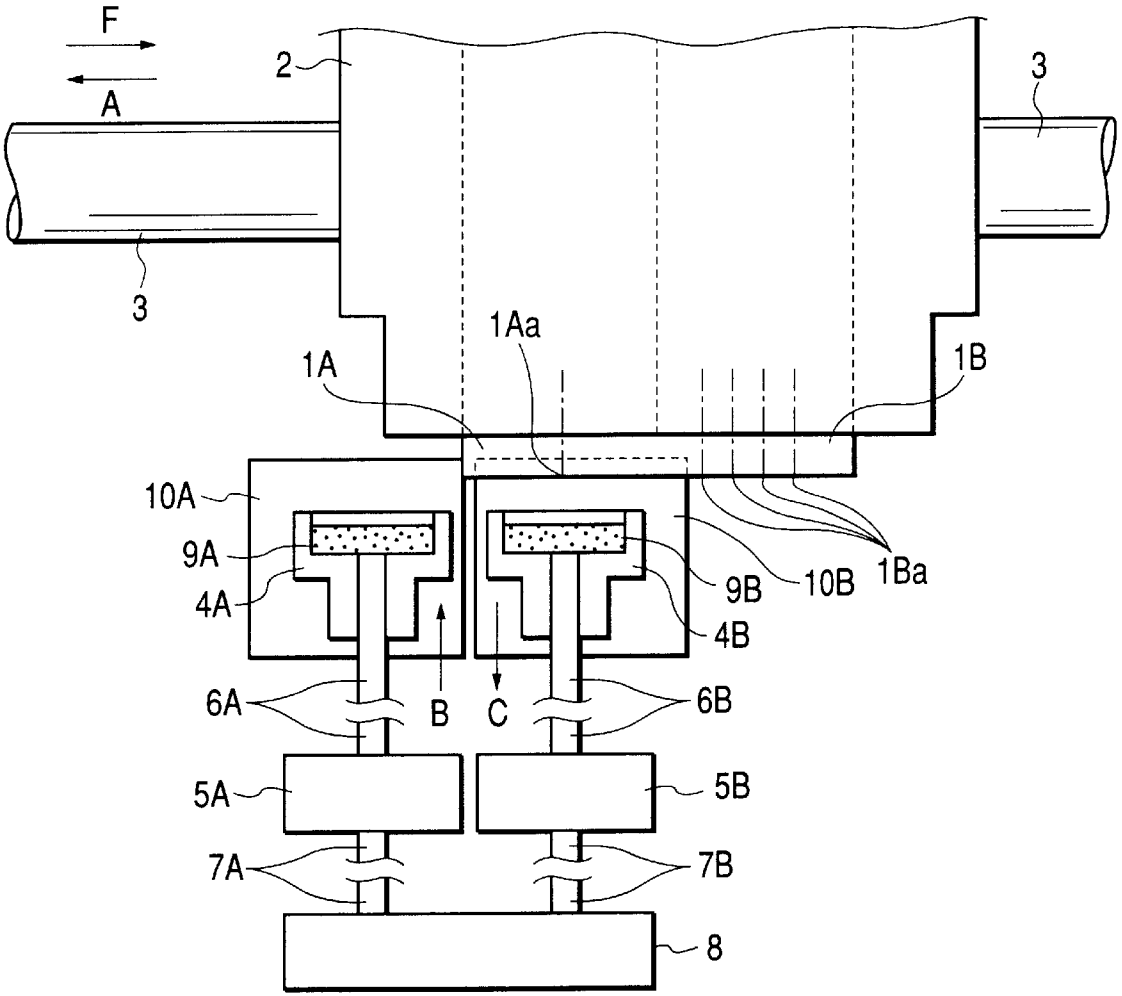
FIG. 5 is a schematic front view showing a non-capping condition in which the pigment ink head is opposed to the dye ink head cap in the recovery device of FIG. 3.
Figure 6:
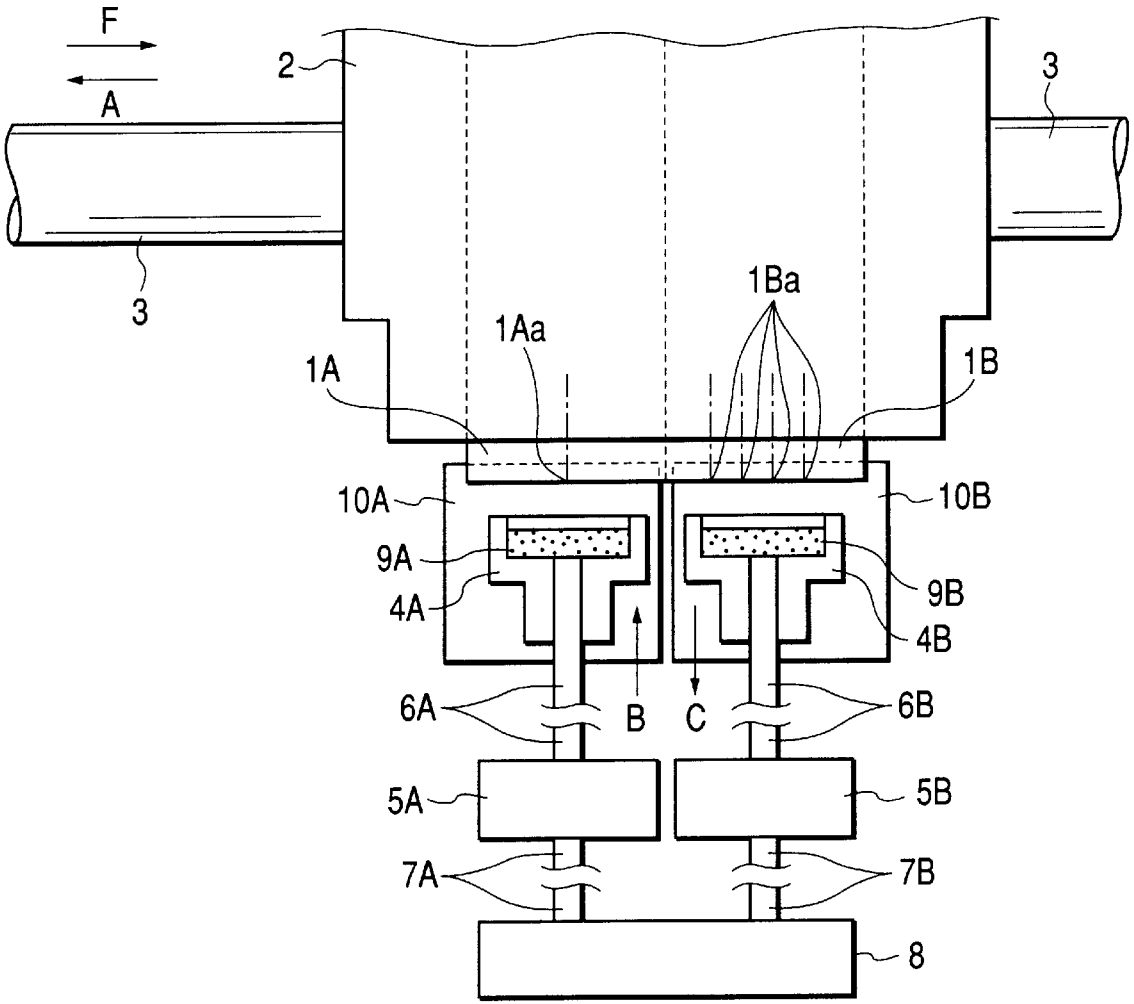
FIG. 6 is a schematic front view showing a non-capping condition in which the pigment ink head is opposed to the pigment ink head cap and the dye ink head is opposed to the dye ink head cap in the recovery device of FIG. 3.
Figure 7:
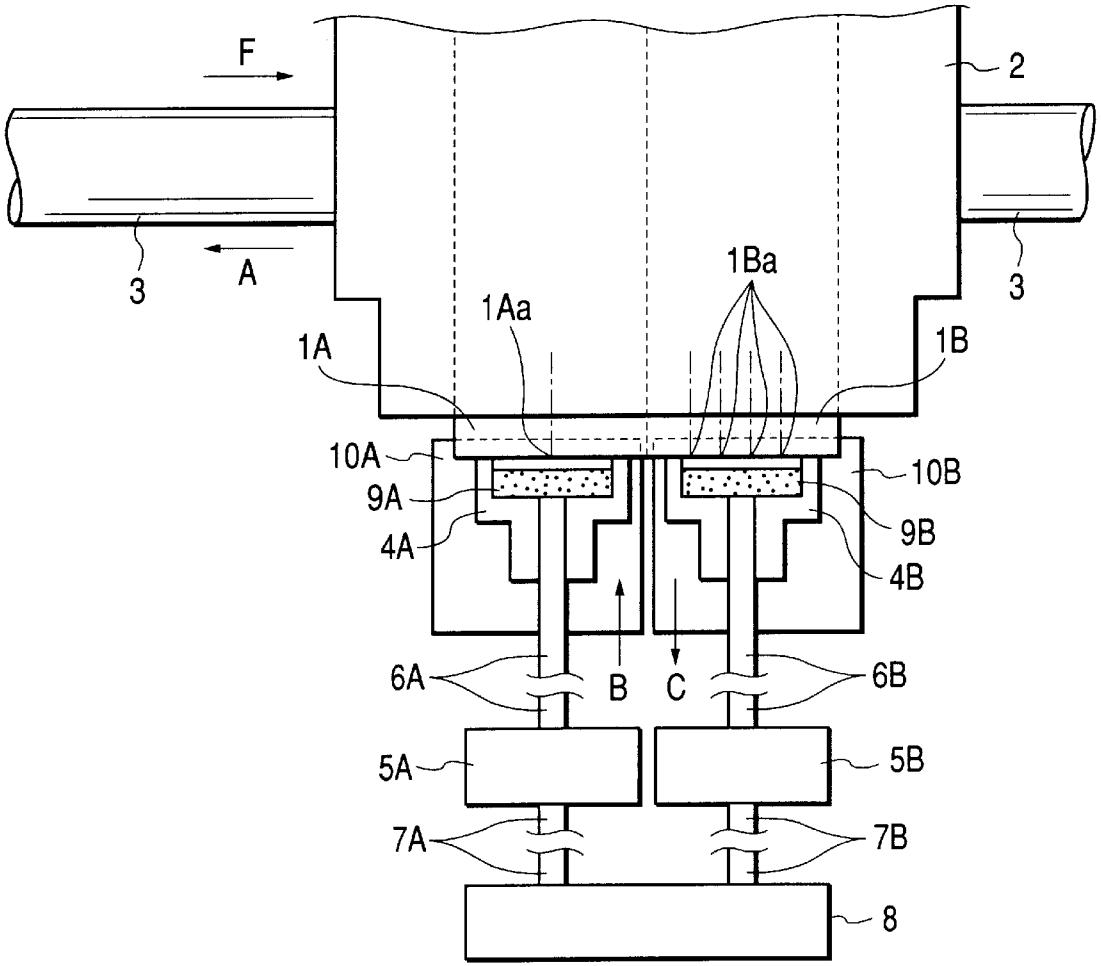
FIG. 7 is a schematic front view showing a capping condition in which the pigment ink head is opposed to the pigment ink head cap and the dye ink head is opposed to the dye ink head cap in the recovery device of FIG. 3.

The head recovery device 35 of FIG. 1 has a construction to which the present invention is applied. FIG. 3 is a schematic front view of the head recovery device 35 in a non-capping condition that the dye ink head 1B (dye ink discharge ports 1Ba) is opposed to the cap (capping means) 4A for the pigment ink head (pigment ink discharge ports), FIG. 4 is a schematic front view of the head recovery device 35 in a capping condition that the dye ink head 1B is opposed to the cap 4A for the pigment ink head, FIG. 5 is a schematic front view of the head recovery device 35 in a non-capping condition that the pigment ink head 1A is opposed to the cap (capping means) 4B for the dye ink head, FIG. 6 is a schematic front view of the head recovery device 35 in a non-capping condition that the pigment ink head 1A (pigment ink discharge ports 1Aa) is opposed to the cap 4A for the pigment ink head and the dye ink head 1B is opposed to the cap 4B for the dye ink head (dye ink discharge ports), and FIG. 7 is a schematic front view of the head recovery device 35 in a capping condition that the pigment ink head 1A is opposed to the cap 4A for the pigment ink head and the dye ink head 1B is opposed to the cap 4B for the dye ink head.

Figure 8:
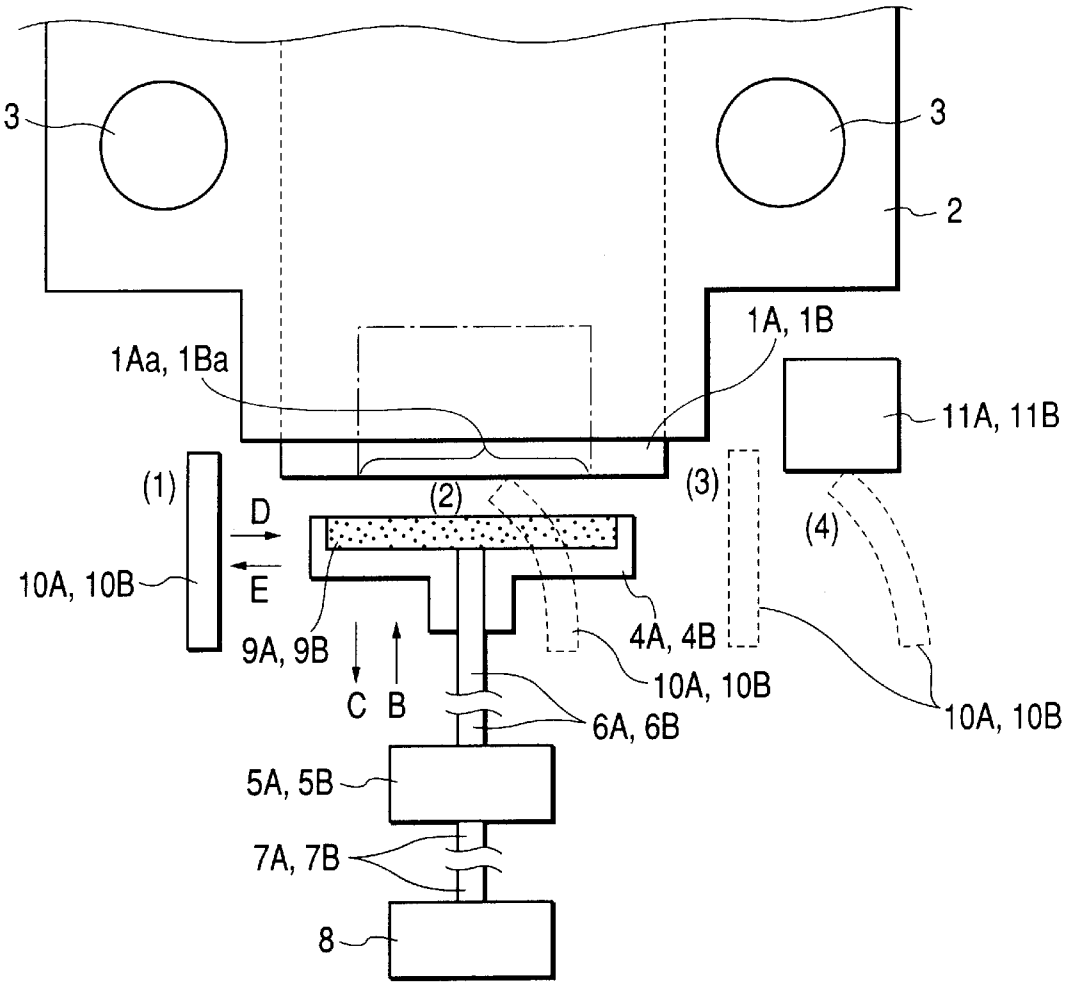
FIG. 8 is a schematic front view showing a non-capping condition in which at least one of the pigment ink head and the dye ink head is opposed to at least one of the pigment ink head cap and the dye ink head cap in the recovery device of FIG. 3.
Figure 9:
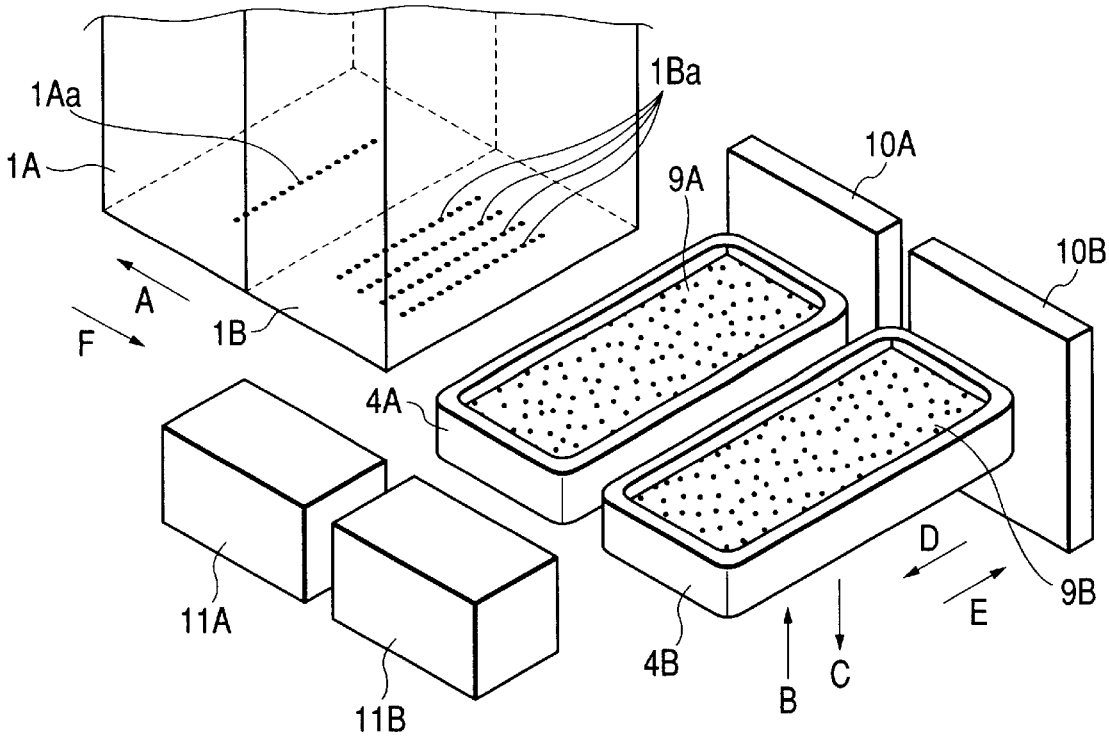
FIG. 9 is a schematic perspective view showing a condition that the head recovery device of FIG. 3 is looked at from an oblique upward direction.
Figure 10:
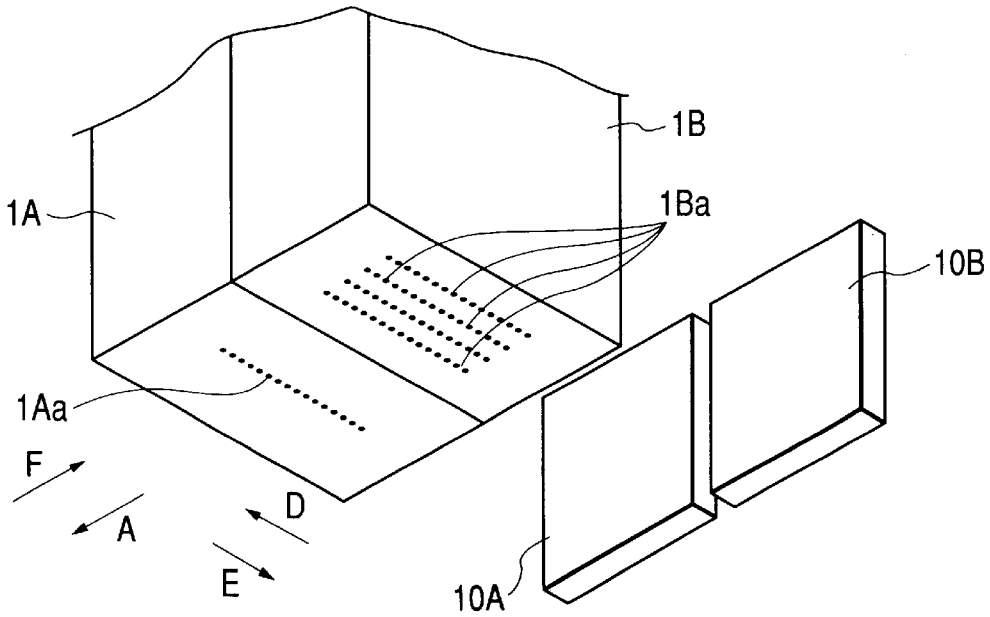
FIG. 10 is a schematic perspective view showing cleaning means of the recovery device of FIG. 3 and a head (discharge port), looked at from a downward direction.
Figure 11:
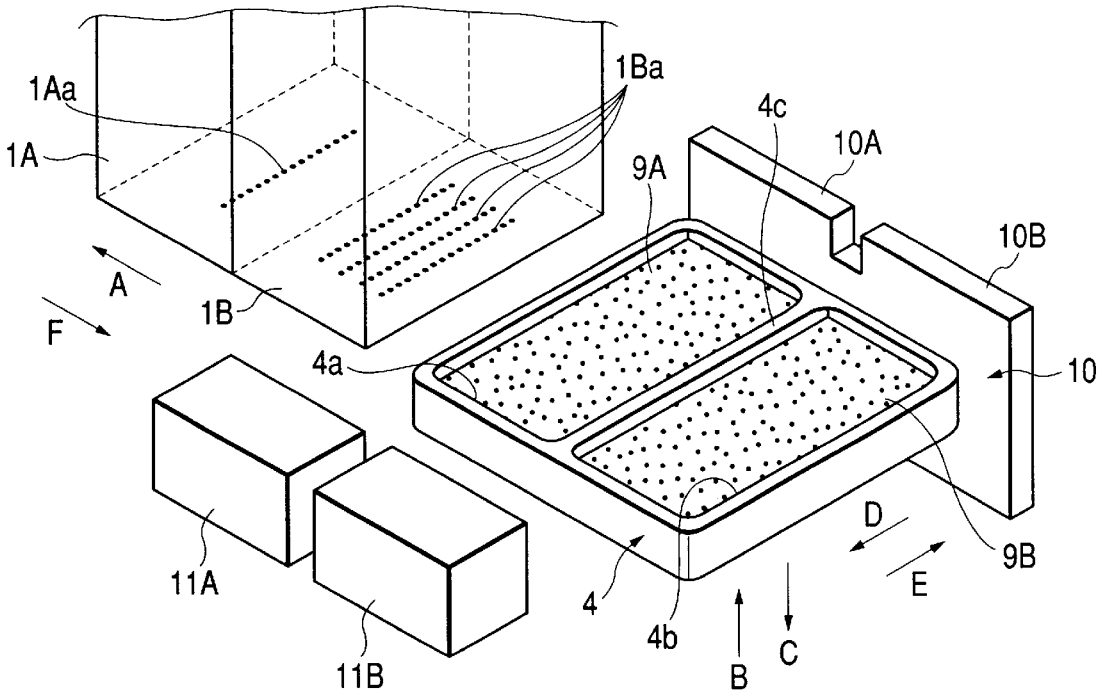
FIG. 11 is a schematic perspective view showing another embodiment of a head recovery device to which the present invention is applied, looked at from an oblique upward direction.
Figure 12:
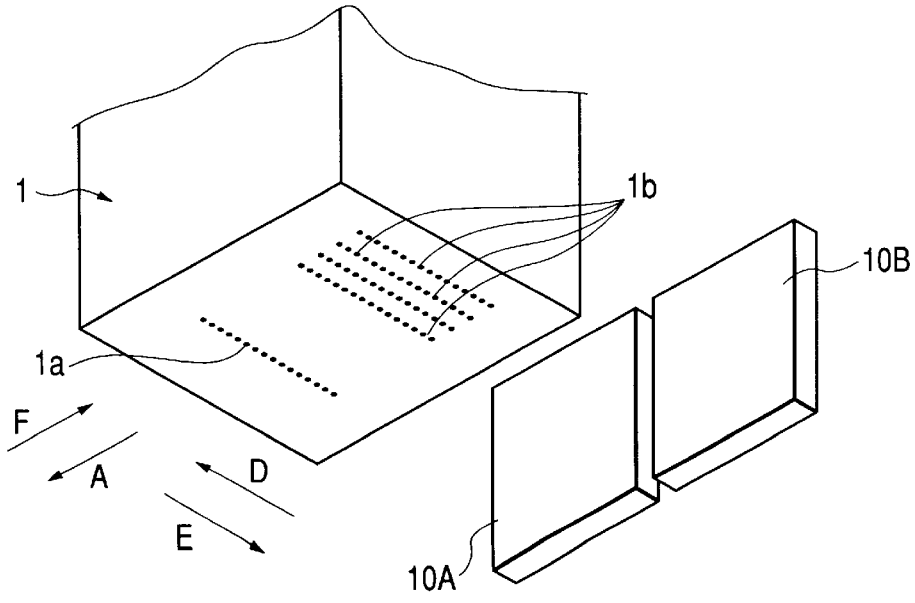
FIG. 12 is a schematic perspective view showing cleaning members of the head recovery device to which the present invention is applied and an integral head, looked at from a downward direction.
Figure 13:
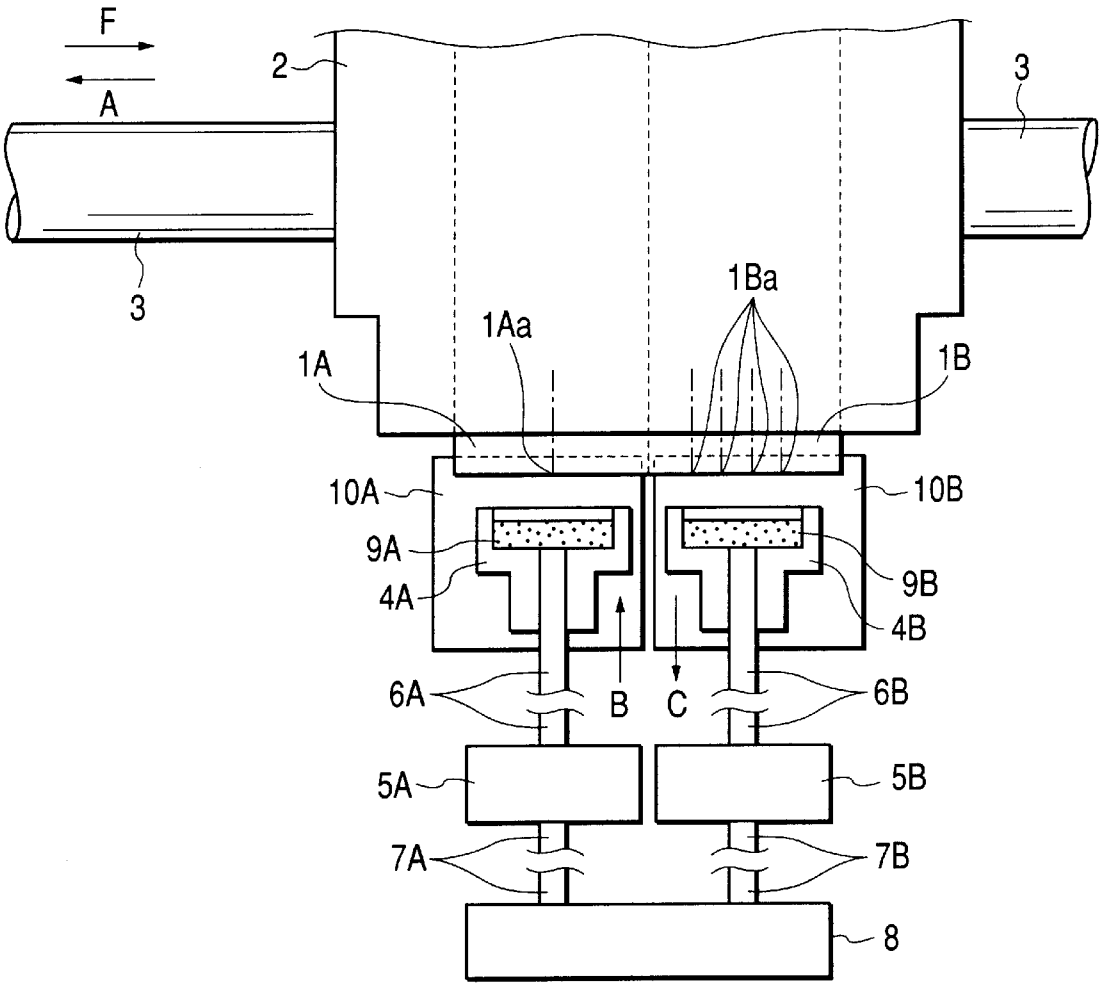
FIG. 13 is a schematic front view showing a head recovery device for explaining a conventional recovery operation in an ink jet recording apparatus.
Figure 14:
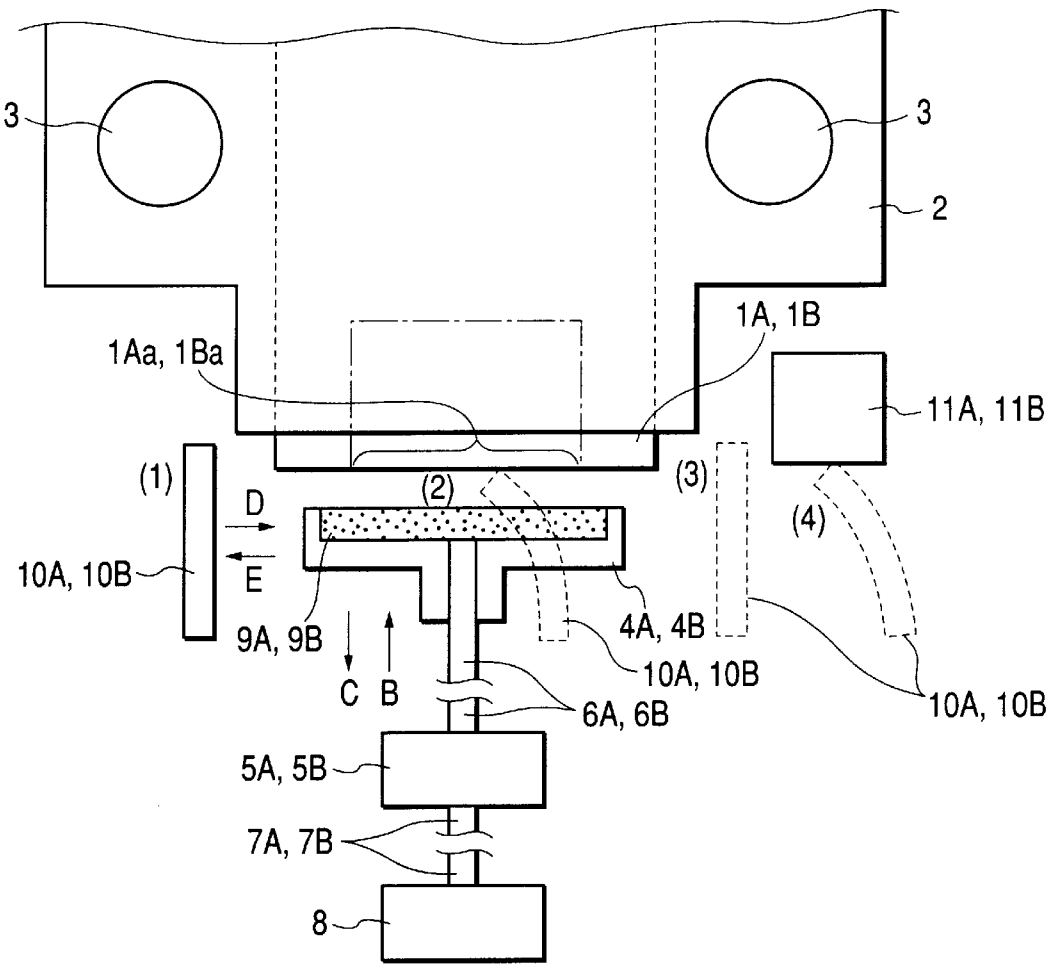
FIG. 14 is a schematic side view of the head recovery device for explaining the conventional recovery operation in the ink jet recording apparatus.

Further, FIG. 8 is a schematic side view of the head recovery device 35 in a non-capping condition that the at least one of the pigment ink head 1A and the dye ink head 1B is opposed to at least one of the cap 4A for the pigment ink head and the cap 4B for the dye ink head, FIG. 9 is a schematic perspective view of the head recovery device 35, looked at from an oblique upward direction, and FIG. 10 a schematic perspective view showing the cleaning means of the head recovery device 35 and the heads, looked at from a downward direction. Further, FIG. 11 is a schematic perspective view showing another embodiment of a head recovery device to which the present invention is applied, looked at from an oblique upward direction and FIG. 12 is a schematic perspective view showing cleaning members of the head recovery device to which the present invention is applied and an integral head, looked at from a downward direction.

First of all, a normal head recovery operation will be explained with reference to FIGS. 6 to 10. In FIGS. 6 to 10, a pigment ink head (black head) 1A serves to discharge pigment ink (for example, black ink), a dye ink head (color head) 1B serves to discharge dye ink (for example, color ink), a main scanning carriage 2 serves to position and hold the pigment ink head 1A and the dye ink head 1B, and a pair of main scanning rails 3 serve to guide and hold the main scanning carriage 2 for a reciprocal shifting movement in a direction A as a recording direction. A cap (capping means; and capable of being used as preliminary discharge receiving means) 4A for the pigment ink head is made of rubber elastic material and serves to form a sealingly closed system by abutting against a discharge port portion 1Aa of the pigment ink head 1A, and a cap (capping means; and capable of being used as preliminary discharge receiving means) 4B for the dye ink head is made of rubber elastic material and serves to form a sealingly closed system by abutting against a discharge port portion 1Ba of the dye ink head 1B. These caps 4A, 4B are positioned and held by a holder member (not shown) for shifting movements in a capping direction (shown by the arrow B) and a non-capping direction (shown by the arrow C) by means of driving sources (not shown).

Cap absorption members 9A, 9B are disposed within the caps 4A, 4B, respectively. These cap absorption members 9A, 9B are formed from porous material or sponge material capable of absorbing and holding the ink. As shown in FIG. 6, in a non-capping condition that the caps 4A, 4B are positioned and held at positioned spaced apart from the heads 1A, 1B, preliminary discharge in which the ink is discharged from discharge ports 1Aa, 1Ba of the heads 1A, 1B toward the cap absorption members 9A, 9B is effected. The preliminary discharge is an operation for preventing the ink from being viscosity-increased and solidified in the discharge port portions 1Aa, 1Ba during recording and is normally performed at a predetermined interval. Further, the preliminary discharge may be effected toward the preliminary discharge receiving means (not shown). The preliminary discharge receiving means can be constituted by a container or an ink absorbing member, for example.

The reference numeral 5A denotes a pigment ink head (pigment ink discharge port) suction pump (suction means) 5A; and 5B denotes a dye ink head (dye ink discharge port) suction pump (suction means). As shown in FIG. 7, in a capping condition that the caps 4A, 4B abut against (closely contact with) the heads 1A, 1B, suction recovery in which predetermined suction negative pressure (suction force) is generated at the discharge port portions 1Aa, 1Ba of the heads 1A, 1B thereby to forcibly suck the ink from the discharge port portions 1Aa, 1Ba through first tubes 6A, 6B and to discharge the sucked ink to a waste ink treating member 8 through second tubes 7A, 7B is performed. The suction pumps (suction means) 5A, 5B serve to perform such suction recovery. Further, the suction recovery may be effected immediately before the initiation of the recording, or, for every predetermined time interval or recording operation during the recording, or whenever the fact that the recovery operation is required is detected, if necessary.

A pigment ink head (black head) cleaning member (cleaning means) 10A and a dye ink head (color head) cleaning member (cleaning means) 10B are formed from rubber material such as urethane, butyl or silicone, or porous material or sponge material. The cleaning members 10A, 10B can be shifted in directions shown by the arrows D, E by means of driving sources (not shown), so that, when shifted in the direction D, these members slide on the head face (discharge port face in which the discharge ports are formed) including the discharge port portions 1Aa, 1Ba (broken line positions (1)→(2)→(3)→(4) in FIG. 8), thereby effecting cleaning (by sweeping) of the head face. After the cleaning is finished, when the members are further shifted in the direction D, the cleaning members 10A, 10B abut against cleaners 11A, 11B (broken line position (4)). Namely, by abutting the cleaning members 10A, 10B against the cleaners 11A, 11B, foreign matters such as ink droplet, debris, dirt and/or paper powder scraped from the head face are transferred from the cleaning members 10A, 10B to the cleaners 11A, 11B for collection. In this case, the caps 4A, 4B are shifted in the direction C by the driving sources (not shown) to be retarded to positions (not shown) where they do not interfere with the cleaning members 10A, 10B.

In the normal recovery operation as described with reference to FIGS. 6 to 10, the ink suction, cleaning and preliminary discharge for the pigment ink head 1A are performed by using the pigment ink head cap (capping means) 4A, ink absorption member 9A and cleaning member (cleaning means) 10A. Further, the suction, cleaning and preliminary discharge for the dye ink head 1B are performed by using the dye ink head cap (capping means) 4B, ink absorption member 9B and cleaning member (cleaning means) 10B.

Next, various embodiments of recovery operations for preventing adhesion and deposition of the pigment ink onto the discharge port face (head face) near the pigment ink discharge ports or the cleaning member and for removing the pigment ink if the ink is adhered or deposited, which are characteristic part of the present invention, will be explained with reference to FIGS. 3 to 12. However, these embodiments can be realized not only solely but also in combination, and, when combined, since the technical effects can be further enhanced, the present invention also includes any combination of the embodiments.

<First Embodiment>

First of all, a first embodiment will be described with reference to FIGS. 3, 6, 7 and 8. In a capping condition shown in FIG. 7, the negative pressure is generated within the dye ink head (dye ink discharge port) cap (capping means) 4B by the suction pump (suction means) 5B, thereby forcibly sucking and discharging the dye ink from the discharge ports (dye ink discharge ports) 1Ba of the dye ink head 1B. Thereafter, the cap 4B is shifted and retarded by the driving source (not shown) in the direction C (refer to FIG. 6). In this case, a part of the dye ink discharged by the suction remains on the head face (discharge port face) of the dye ink head 1B in the adhered condition. In this condition, the main scanning carriage 2 is shifted in the direction A, so that the dye ink head 1B (dye ink discharge ports 1Ba) is shifted to and stopped at a position where the head is opposed to the pigment ink head (pigment ink discharge ports) cleaning member (cleaning means) 10A as shown in FIG. 3. In this condition, as shown in FIG. 8, the cleaning member 10A is shifted in the direction D by the driving source (not shown), so that the head face in cleaned by slidingly contacting (broken line positions (1)→(2)→(3)) the cleaning member 10A with the head face including the discharge port portions 1Ba of the dye ink head 1B.

In this case, the dye ink which was adhered to the head face of the dye ink head 1B is applied onto the pigment ink head cleaning member 10A. As a result, the dye ink is applied to the pigment ink adhered and deposited on the pigment ink head cleaning member 10A (including a condition that the pigment ink tries to be adhered and deposited), with the result that the adhered and deposited pigment ink is dissolved by application of the dye ink thereto and is removed from the cleaning member 10A. The removal of the dissolved pigment ink is performed, for example, by abutment of the cleaning member 10A against the cleaner 11A. Further, by providing a predetermined wait time (waiting time) after the dye ink is applied, the dissolution is sufficiently progressed, thereby enhancing the removing ability for the adhered and deposited pigment ink.

<Second Embodiment>

Next, an arrangement in which the suction operation for the dye ink head is effected by using the pigment ink head capping means (cap), which is a second embodiment of the recovery operation for removing the adhered and deposited pigment ink (including a condition that the pigment ink tries to be adhered and deposited), will be described with reference to FIGS. 3, 4 and 8. From the condition shown in FIG. 6, the main scanning carriage 2 is shifted in the direction A, so that the dye ink head 1B is shifted to and stopped at a position where the head is opposed to the pigment ink head cap 4A as shown in FIG. 3. From this condition, the pigment ink head cap 4A is shifted in the direction B by the driving source (not shown) so that the dye ink head 1B is capped by the pigment ink head cap 4A as shown in FIG. 2. In this capping condition, the negative pressure is generated within the pigment ink head cap 4A, thereby forcibly sucking and discharging the dye ink from the discharge ports 1Ba of the dye ink head 1B. Then, the cap 4A is shifted by the driving source (not shown) in the direction C to restore the condition shown in FIG. 3 again. In this case, a part of the dye ink discharged by the suction remains on the head face of the dye ink head 1B in the adhered condition.

In this condition, as shown in FIG. 8, the cleaning member 10A is shifted in the direction D by the driving source (not shown), so that the head face is cleaned by slidingly contacting (broken line positions (1)→(2)→(3)) the cleaning member 10A with the head face including the discharge port portions 1Ba of the dye ink head 1B. Succeeding operations are the same as those in the first embodiment in which the suction is effected by using the dye ink head cap 4B. That is to say, in this case, the dye ink which was adhered to the head face of the dye ink head 1B is applied onto the pigment ink head cleaning member 10A. As a result, the dye ink is applied to the pigment ink adhered and deposited on the pigment ink head cleaning member 10A (including a condition that the pigment ink tries to be adhered and deposited), with the result that the adhered and deposited pigment ink is dissolved by application of the dye ink thereto and is removed from the cleaning member 10A. The removal of the dissolved pigment ink is performed, for example, by abutment of the cleaning member 10A against the cleaner 11A. Further, by providing a predetermined wait time (waiting time) after the dye ink is applied, the dissolution is sufficiently progressed, thereby enhancing the removing ability for the adhered and deposited pigment ink.

<Third Embodiment>

In the above-mentioned first and second embodiments, an arrangement in which the dye ink is adhered to the head face of the dye ink head 1B by the ink suction by means of the suction means (suction pump) and the dye ink is applied to the pigment ink head cleaning member 10A by cleaning the head face by means of the pigment ink head cleaning member 10A was explained. In a third embodiment, as well as such ink suction, the application of the dye ink can be effected by preliminary discharge which will be described hereinbelow. Namely, by using an arrangement in which the dye ink is filled within the cap by effecting preliminary discharge for discharging the dye ink from the discharge ports into the cap (normally toward the ink absorption member) in a capping condition and the dye ink in the cap is adhered to the head face, the same technical effect as that in the above-mentioned ink suction can be achieved.

The third embodiment using such preliminary discharge will now be described with reference to FIGS. 3, 6, 7 and 8. In a capping condition shown in FIG. 7, the preliminary discharge for discharging the dye ink from the discharge ports 1Ba of the dye ink head 1B is performed to fill the dye ink head cap 4B with the preliminarily discharged dye ink. Then, the cap 4B is shifted in the direction C by the driving source (not shown) to bring it to a non-capping condition as shown in FIG. 6. In this case, a part of the dye ink discharged into the cap 4B by the preliminary discharge remains on the head face of the dye ink head 1B in the adhered condition. From such a condition shown in FIG. 6, the main scanning carriage 2 is shifted in the direction A, so that the dye ink head 1B is shifted to and stopped at a position (condition shown in FIG. 3) where the dye ink head 1B is opposed to the pigment ink head cleaning member 10A.

In this condition, as shown in FIG. 8, the cleaning member 10A is shifted in the direction D by the driving source (not shown), so that the head face is cleaned by slidingly contacting (broken line positions (1)→(2)→(3)) the cleaning member 10A with the head face including the discharge port portions 1Ba of the dye ink head 1B. In this case, the dye ink which was adhered to the head face of the dye ink head 1B is applied onto the pigment ink head cleaning member 10A. As a result, the dye ink is applied to the pigment ink adhered and deposited on the pigment ink head cleaning member 10A (including a condition that the pigment ink tries to be adhered and deposited), with the result that the adhered and deposited pigment ink is dissolved by application of the dye ink thereto and is removed from the cleaning member 10A. The removal of the dissolved pigment ink is performed, for example, by abutment of the cleaning member 10A against the cleaner 11A. Further, by providing a predetermined wait time (waiting time) after the dye ink is applied, the dissolution is sufficiently progressed, thereby enhancing the removing ability for the adhered and deposited pigment ink.

<Fourth Embodiment>

Next, an arrangement in which the preliminary discharge of the capped dye ink head (dye ink discharge ports 1Ba) is effected by using the pigment ink head (pigment ink discharge port) capping means (cap) 4A, which is a fourth embodiment of the recovery operation for removing the adhered and deposited pigment ink (including a condition that the pigment ink tries to be adhered and deposited), will be described with reference to FIGS. 3, 4 and 8. From the condition shown in FIG. 6, the main scanning carriage 2 is shifted in the direction A, so that the dye ink head 1B is shifted to and stopped at a position where the head is opposed to the pigment ink head cap 4A as shown in FIG. 3. From this condition, the pigment ink head cap 4A is shifted in the direction B by the driving source (not shown) so that the dye ink head 1B is capped by the pigment ink head cap (capping means) 4A as shown in FIG. 4. In this capping condition, the preliminary discharge from the discharge ports 1Ba of the dye ink head 1B is effected to fill the pigment ink head cap 4A with the preliminarily discharged dye ink. Then, the cap 4A is shifted by the driving source (not shown) in the direction C to restore the non-capping condition shown in FIG. 3 again. In this case, a part of the dye ink discharged by the preliminary discharge remains on the head face (discharge port face) of the dye ink head 1B in the adhered condition.

In this condition, as shown in FIG. 8, the cleaning member 10A is shifted in the direction D by the driving source (not shown), so that the head face is cleaned by slidingly contacting (broken line positions (1)→(2)→(3)) the cleaning member 10A with the head face including the discharge port portions 1Ba of the dye ink head 1B. In this case, the dye ink which was adhered to the head face of the dye ink head 1B is applied onto the pigment ink head cleaning member 10A. As a result, the dye ink is applied to the pigment ink adhered and deposited on the pigment ink head cleaning member 10A (including a condition that the pigment ink tries to be adhered and deposited), with the result that the adhered and deposited pigment ink is dissolved by application of the dye ink thereto and is removed from the cleaning member 10A. The removal of the dissolved pigment ink is performed, for example, by abutment of the cleaning member 10A against the cleaner 11A. Further, by providing a predetermined wait time (waiting time) after the dye ink is applied, the dissolution is sufficiently progressed, thereby enhancing the removing ability for the adhered and deposited pigment ink.

<Fifth Embodiment>

In the above-mentioned first to fourth embodiments, an arrangement in which the dye ink is adhered to the head face of the dye ink head by effecting the suction operation or the preliminary discharge in the capping condition and the dye ink is applied to the pigment ink head cleaning member by cleaning the head face by means of the pigment ink head cleaning member was explained. In place of this, by applying the dye ink applied to the cleaning member onto the head face of the pigment ink head by means of the cleaning operation, the similar technical effect to the above-mentioned one can be achieved. Namely, by using an arrangement in which the dye ink is applied to the head face by the cleaning operation and the pigment ink adhered and deposited to the head face of the pigment ink head is dissolved by the applied dye ink to remove the dissolved pigment ink, the similar effect can be achieved. A fifth embodiment having such an arrangement will now be described with reference to FIGS. 3, 6, 8 and 9.

In the fifth embodiment, operations before the head face of the dye ink head 1B is cleaned are effected in the same manner as those in the first to fourth embodiments. Namely, after the suction operation or the preliminary discharge is performed, operations before the head face is cleaned slidingly contacting (broken line positions (1)→(2)→(3)) the cleaning member with the head face including the discharge port portions 1Ba of the dye ink head 1B by shifting the cleaning member 10A by means of the driving source (not shown) in the direction as shown in FIG. 8 are performed in the same manner as mentioned above. In the fifth embodiment, thereafter, the following operations are effected.

That is to say, after the head face to which the dye ink is adhered is cleaned, the main scanning carriage 2 is shifted in the direction A so that the pigment ink head 1A and the dye ink head 1B are retarded to positions out of the operating areas of the cleaning members 10A, 10B as shown in FIG. 9. In this condition, the pigment ink head cleaning member 10A is shifted in the direction E (FIG. 8) by the driving source (not shown), thereby returning the cleaning member 10A to the start position ((3)→(1)). In this case, the dye ink head cleaning member 10B remains in a condition that the dye ink is applied to that member. Then, the main scanning carriage 2 is shifted in the direction F, so that the pigment ink head 1A is shifted to and stopped at a position (FIG. 6) corresponding to the pigment ink head cleaning member 10A.

Then, as shown in FIG. 8, the cleaning member 10A is shifted in the direction D by the driving source (not shown), so that the head face is cleaned by slidingly contacting (broken line positions (1)→(2)→(3)) the cleaning member 10A with the head face including the discharge port portions 1Aa of the pigment ink head 1A. By this cleaning operation, the dye ink applied to the pigment ink head cleaning member 10A by the process including the suction operation or the preliminary discharge is applied to the head face of the pigment ink head 1A. As a result, the dye ink is applied to the pigment ink adhered and deposited on the head face of the pigment ink head 1A, with the result that the adhered and deposited pigment ink is dissolved by the applied dye ink and is removed from the head face. The removal of the dissolved pigment ink can easily be performed, for example, by cleaning (sweeping) the head face by the cleaning member or other member. Further, by providing a predetermined wait time (waiting time) after the dye ink is applied, the dissolution is sufficiently progressed, thereby enhancing the removing ability for the adhered and deposited pigment ink.

<Sixth Embodiment>

In the fifth embodiment, while an arrangement in which the dye ink is applied to the pigment ink head cleaning member 10A and the dye ink is applied to the pigment ink adhered and deposited on the head face of the pigment ink head by the operation for cleaning the pigment ink head cleaning member 10A was explained, the same technical effect as that in the fifth embodiment can be achieved by using the dye ink head cleaning member 10B. Such a sixth embodiment will now be described with reference to FIGS. 5, 6, 8 and 9. Incidentally, in the sixth embodiment, the suction operation regarding the dye as ink head in the first and second embodiments or the preliminary discharge regarding the dye ink head as in the third and fourth embodiments, is carried out similarly. Namely, the operations until the dye ink is adhered to the head face by effecting the suction operation or the preliminary discharge in the capping condition is carried out similarly. Further, in the sixth embodiment, similar to the first to fourth embodiments, as the capping means, the pigment ink head cap 4A or the dye ink head cap 4B may be used.

In the sixth embodiment, after the operation till the suction operation regarding the dye ink head in the first and second embodiments or the preliminary discharge regarding the dye ink head in the third and fourth embodiments are performed, the main scanning carriage 2 is shifted to a position (FIG. 8) where the dye ink head 1B corresponds to the dye ink head cleaning member 10B and is stopped there. Incidentally, when the suction operation or the preliminary discharge regarding the dye ink head 1B as the pre-operation is performed by using the dye ink head cap 4B, this movement of the main scanning carriage 2 is not needed. Then, in this condition, as shown in FIG. 8, the dye ink head cleaning member 10B is shifted by the driving source (not shown) in the direction D, so that the head face is cleaned by slidingly contacting (broken line positions (1)→(2)→(3)) the cleaning member 10B with the head face including the discharge port portions 1Ba of the dye ink head 1B.

Thereafter, the main scanning carriage 2 is shifted in the direction A, so that the pigment ink head 1A and the dye ink head 1B are retarded to the positions (FIG. 9) out of the operating areas of the cleaning members 10A, 10B. In this condition, the dye ink head cleaning member 10B is shifted in the direction E (FIG. 8) by the driving source (not shown), thereby returning the cleaning member 10B to the cleaning start position ((3)→(1)). In this case, the dye ink head cleaning member 10B remains in a condition that the dye ink is applied to that member. Then, the main scanning carriage 2 is shifted in the direction F, so that the pigment ink head 1A is shifted to and stopped at the position corresponding to the dye ink head cleaning member 10B.

Then, as shown in FIG. 8, the dye ink head cleaning member 10B is shifted by the driving source (not shown) in the direction D, so that the head face is cleaned by slidingly contacting (broken line positions (1)→(2)→(3)) the cleaning member 10B with the head face including the discharge port portions 1Aa of the pigment ink head 1A. By this cleaning operation, the dye ink applied to the dye ink head cleaning member 10B by the process including the suction operation or the preliminary discharge is applied to the head face of the pigment ink head 1A. As a result, the dye ink is applied to the pigment ink adhered and deposited on the head face of the pigment ink head 1A, with the result that the adhered and deposited pigment ink is dissolved by the applied dye ink and is removed from the head face. The removal of the dissolved pigment ink can easily be performed, for example, by cleaning (sweeping) the head face by the cleaning member or other member. Further, by providing a predetermined wait time (waiting time) after the dye ink is applied, the dissolution is sufficiently progressed, thereby enhancing the removing ability for the adhered and deposited pigment ink.

<Seventh Embodiment>

In the above-mentioned first to fourth embodiments, an arrangement in which the dye ink is adhered to the head face of the dye ink head by effecting the suction operation or the preliminary discharge and the dye ink is applied to the pigment ink head cleaning member by cleaning the head face by means of the pigment ink head cleaning member was explained. Other than this, the same technical effects as those in the first to fourth embodiments can be achieved by using an arrangement in which the dye ink discharged from the dye ink head by the preliminary discharge is applied to the pigment ink head cleaning member. Such a seventh embodiment will now be described with reference to FIGS. 3 and 8.

In the seventh embodiment, in the non-capping condition, the main scanning carriage 2 is shifted, so that the dye ink head 1B is shifted to a position corresponding to the pigment ink head cleaning member 10A and is stopped there (condition shown in FIG. 3). Then, as shown in FIG. 8, the pigment ink head cleaning member 10A is shifted by the driving source (not shown) in the direction D to be moved up to an area of the discharge port portions 1Ba of the dye ink head 1B (broken line positions (1)→(2)). In this condition, the preliminary discharge regarding the discharge port portions 1Ba of the dye ink head 1B is effected, so that the dye ink discharged by this preliminary discharge is applied to the pigment ink head cleaning member 10A.

Further, in FIG. 8, while the preliminary discharge was performed during the cleaning operation, an arrangement in which, in the condition that the pigment ink head cleaning member 10A is shifted by the driving source (not shown) in the direction C, the pigment ink head cleaning member 10A is shifted by the driving source (not shown) in the direction D to shift the area of the discharge port portions 1Ba of the dye ink head 1B, and the preliminary discharge regarding the dye ink head 1B is performed in a condition that the cleaning member 10A does not abut against the head face may be used. Also in this case, the same technical effect can be achieved.

<Eighth Embodiment>

In this fifth embodiment, while an arrangement in which the dye ink is applied to the head face of the dye ink head by the suction operation or the preliminary discharge and the dye ink is applied to the cleaning member by cleaning the head face by means of the cleaning member and further the dye ink applied to the cleaning member is applied to the head face of the pigment ink head 1A by the cleaning operation was explained, in this case, the application of the dye ink to the cleaning member can be realized by the preliminary discharge regarding the discharge port portions 1Ba of the dye ink head 1B. Such an arrangement in which the dye ink is applied to the cleaning member by the preliminary discharge can also achieve the same technical effect as that in the fifth embodiment. Such an eighth embodiment will now be described with reference to FIGS. 3, 6 and 8.

In the eighth embodiment, for example, in the non-capping condition shown in FIG. 6, the main scanning carriage 2 is shifted so that the dye ink head 1B is shifted to the position corresponding to the pigment ink head cleaning member 10A or corresponding to the dye ink head cleaning member 10B, and then the main scanning carriage 2 is stopped there. Then, as shown in FIG. 8, the pigment ink head cleaning member 10A or to the dye ink head cleaning member 10B is shifted by the driving source (not shown) in the direction D to me moved in the area of the discharge port portions 1Ba of the dye ink head 1B (broken line positions (1)→(2)). In this condition, the preliminary discharge regarding the discharge port portions 1Ba of the dye ink head 1B is effected, so that the dye ink discharged by this preliminary discharge discharged by this preliminary discharge is applied to the dye ink head cleaning member 10B or the pigment ink head cleaning member 10A.

Then, the pigment ink head cleaning member 10A or the dye ink head cleaning member 10B is further shifted in the direction and then is stopped (broken line positions (2)→(3)). By the above operations, the dye ink discharged from the dye ink head 1B by the preliminary discharge is applied to the pigment ink head cleaning member 10A or the dye ink head cleaning member 10B. Then, the dye ink is applied to the pigment ink head 1A. In this case, when the pigment ink head cleaning member 10A is used, the same arrangement is obtained as that in the fifth embodiment, and, when the dye ink head cleaning member 10B is used, the same arrangement is obtained as that in the sixth embodiment. Accordingly, since the explanation regarding the fifth embodiment or the sixth embodiment may be referred to, detailed explanation thereof will be omitted.

<Ninth Embodiment>

In the first to eighth embodiments, while an arrangement in which the pigment ink head cap (capping means) 4A and the dye ink head cap (capping means) 4B are formed from separate members was explained, an integral cap may be used. That is to say, the same technical effect can be achieved by using an integral cap having a cap chamber for the discharge ports of the pigment ink head 1A and a cap chamber for the discharge ports of the dye ink head 1B to form independent sealingly closed systems for the respective discharge ports. Such a ninth embodiment will now be described with reference to FIG. 11.

In FIG. 11, an integral cap 4 has a cap chamber 4*a*for the discharge ports of the pigment ink head 1A and a cap chamber 4*b* for the discharge ports of the dye ink head 1B, which cap chambers are isolated from each other by a partition portion 4*c*, and these cap chambers 4*a*, 4*b* forms separate sealingly closed systems for the respective discharge ports independently. The other constructions of the ninth embodiment are substantially the same as those in other embodiments as mentioned above and can be implemented in combination with any one of the above-mentioned first to eighth embodiments.

<Tenth Embodiment>

In the first to eighth embodiments, while an arrangement in which the pigment ink head cleaning member 10A and the dye ink head cleaning member 10B are formed from separate members was explained, a single cleaning member including a pigment ink head cleaning portion and a dye ink head cleaning portion may be used. Also in this case, the similar technical effect can be achieved. A tenth embodiment having such an arrangement is shown in FIG. 11. In FIG. 11, an integral cleaning member 10 integrally includes a cleaning portion for the pigment ink head 1A, defining a pigment ink head cleaning member 10A, and a cleaning portion for the dye ink head 1B, defining a dye ink head cleaning member 10B. Since the other constructions of the tenth embodiment are substantially the same as those in other embodiments as mentioned above, detailed explanation thereof will be omitted.

<Eleventh Embodiment>

In the first to eighth embodiments, while an arrangement in which the pigment ink head 1A (pigment ink discharge heads 1Aa) and the dye ink head (dye ink discharge ports 1Ba) are formed from separate members was explained, as shown in FIG. 12, an integral head 1 in which pigment ink discharge ports 1*a* and dye ink discharge ports 1*b* are formed in a single head may be used. Also in this case, the same technical effects as those in the previous embodiments can be achieved. An eleventh embodiment having such an arrangement is shown in FIG. 12. Since the other constructions of the eleventh embodiment are substantially the same as those in other embodiments as mentioned above, detailed explanation thereof will be omitted.

Incidentally, in the above-mentioned embodiments, while an example that the ink discharged by the preliminary discharge is received by the capping means (cap) was explained, the ink discharged by the preliminary discharge may be received by preliminary discharge receiving means such as an additional container or ink absorption member. Further, in the above-mentioned embodiments, while the recording apparatus of serial type in which the recording is effected while shifting the recording head (pigment ink head 1A and the dye ink head 1B) in the main scanning direction was explained, the present invention can similarly be applied to a recording apparatus of line type (line type recording apparatus) in which the recording is effected only by means of sub scanning by using a line type recording head having a length covering an entire width or a part of the width of the recording medium, thereby achieving the similar technical effect.

The present invention can freely be implemented regardless of the number of recording heads and can similarly be applied to, as well as a recording apparatus having single recording means, a recording apparatus having a plurality of recording means or a gradation recording apparatus using a plurality of recording means for effecting the recording with same color and with different densities of a recording apparatus including combination thereof, thereby achieving the similar technical effect. Further, the present invention can similarly be applied to an arrangement having any positional relationship between recording head(s) and ink tank(s), such as an arrangement using a detachable head cartridge in which a recording head and an ink tank are integrated or an arrangement in which a recording head is provided independently from an ink tank and these two elements are interconnected by an ink supplying tube and the like, thereby achieving the similar technical effect. Incidentally, although the present invention can be applied to ink jet recording apparatuses using, for example, an electrothermal converters such as piezoelectric elements as recording means, among them, when the present invention is applied to an ink jet recording apparatus using recording means of type for discharging ink by utilizing thermal energy, excellent technical effect can be achieved. According to such a type, high density recording and highly fine recording can be realized.

What is claimed is:

1. A head recovery device of an ink jet recording apparatus having a pigment discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, said dye ink discharge port is sucked, and then said dye ink discharge port face is cleaned by said pigment ink cleaning member.

2. A head recovery device according to claim 1, wherein said pigment ink cleaning member and said dye ink cleaning member are formed integrally with each other.

3. A head recovery device of an ink jet recording apparatus having a pigment ink discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected regarding said dye ink discharge port, and then said dye ink discharge port face is cleaned by said pigment ink cleaning member.

4. A head recovery device of an ink jet recording apparatus having a pigment ink discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected from said dye ink discharge port against said pigment ink cleaning member.

5. A head recovery device of an ink jet recording apparatus having a pigment ink discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, said dye ink discharge port is sucked, and then said dye ink discharge port face is cleaned by said pigment ink cleaning member or said dye ink cleaning member, and thereafter, said pigment ink discharge port face is cleaned by a cleaning member by which said dye ink discharge port face was cleaned.

6. A head recovery device according to claim 5, wherein said pigment ink cleaning member and said dye ink cleaning member are formed integrally with each other.

7. A head recovery device of an ink jet recording apparatus having a pigment ink discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected regarding said dye ink discharge port, and then said dye ink discharge port face is cleaned by said pigment ink cleaning member or said dye ink cleaning member, and thereafter, said pigment ink discharge port face is cleaned by the cleaning member by which said dye ink discharge port face was cleaned.

8. A head recovery device of an ink jet recording apparatus having a pigment ink discharge port for discharging pigment ink and a dye ink discharge port for discharging dye ink, said device comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected from said dye ink discharge port against said pigment ink cleaning member or said dye ink cleaning member, and then said pigment ink discharge port face is cleaned by a cleaning member to which the dye ink was applied.

9. An ink jet recording apparatus having a pigment discharge port for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, said dye ink discharge port is sucked, and then said dye ink discharge port face is cleaned by said pigment ink cleaning member.

10. An ink jet recording apparatus according to claim 9, wherein said pigment ink cleaning member and said dye ink cleaning member are formed integrally with each other.

11. An ink jet recording apparatus having a pigment discharge port for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected regarding said dye ink discharge port, and then said dye ink discharge port face is cleaned by said pigment ink cleaning member.

12. An ink jet recording apparatus having a pigment discharge port for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected from said dye ink discharge port against said pigment ink cleaning member.

13. An ink jet recording apparatus having a pigment discharge port for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, said dye ink discharge port is sucked, and then said dye ink discharge port face is cleaned by said pigment ink cleaning member or said dye ink cleaning member, and thereafter, said pigment ink discharge port face is cleaned by the cleaning member by which said dye ink discharge port face was cleaned.

14. An ink jet recording apparatus according to claim 13, wherein said pigment ink cleaning member and said dye ink cleaning member are formed integrally with each other.

15. An ink jet recording apparatus according to claim 9 or 13, wherein the pigment ink is black ink and the dye ink is color ink.

16. An ink jet recording apparatus according to claim 9 or 13, wherein said pigment ink discharge port is provided in a pigment ink discharge head having an energy generating element for generating energy utilized for discharging the pigment ink from said pigment ink discharge port.

17. An ink jet recording apparatus according to claim 16, wherein said energy generating element is an electrothermal converting element for generating thermal energy.

18. An ink jet recording apparatus according to claim 9 or 13, wherein said dye ink discharge port is provided in a dye ink discharge head having an energy generating element for generating energy utilized for discharging the dye ink from said dye ink discharge port.

19. An ink jet recording apparatus according to claim 18, wherein said energy generating element is an electrothermal converting element for generating thermal energy.

20. An ink jet recording apparatus having a pigment discharge port for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected regarding said dye ink discharge port, and then said dye ink discharge port face is cleaned by said pigment ink cleaning member or said dye ink cleaning member, and thereafter, said pigment ink discharge port face is cleaned by the cleaning member by which said dye ink discharge port face was cleaned.

21. An ink jet recording apparatus having a pigment discharge part for discharging pigment ink and a dye ink discharge port for discharging dye ink, comprising:

a pigment ink cleaning member capable of abutting against a pigment ink discharge port face in which said pigment ink discharge port is provided to effect cleaning of said face; and a dye ink cleaning member capable of abutting against a dye ink discharge port face in which said dye ink discharge port is provided to effect cleaning of said face, wherein, in a predetermined recovery operation, preliminary discharge which does not contribute recording is effected from said dye ink discharge port against said pigment ink cleaning member or said dye ink cleaning member, and then said pigment ink discharge port face is cleaned by the cleaning member to which the dye ink was applied.

22. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face; and applying the dye ink discharged from said dye ink discharge port to said pigment ink cleaning member, wherein, in said applying step, said dye ink discharge port is sucked, and then said dye ink discharge port face is cleaned by said pigment ink cleaning member.

23. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face; and applying the dye ink discharged from said dye ink discharge port to said pigment ink cleaning member, wherein, in said applying step, preliminary discharge which does not contribute recording is effected from said dye ink discharge port, and then said dye ink discharge port face is cleaned by said pigment ink cleaning member.

24. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face; and applying the dye ink discharged from said dye ink discharge port to said pigment ink cleaning member, wherein, in said applying step, preliminary discharge which does not contribute recording is effected from said dye ink discharge port against said pigment ink cleaning member.

25. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face;

applying the dye ink discharged from said dye ink discharge port to at least one of said pigment ink cleaning member and said dye ink cleaning member; and cleaning said pigment ink discharge port face by the cleaning member to which the dye ink was applied, wherein, in said applying step, said dye ink discharge port is sucked, and then said dye ink discharge port face is cleaned by said pigment ink cleaning member or said dye ink cleaning member.

26. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face;

applying the dye ink discharged from said dye ink discharge port to at least one of said pigment ink cleaning member and said dye ink cleaning member; and cleaning said pigment ink discharge port face by the cleaning member to which the dye ink was applied, wherein, in said applying step, preliminary discharge which does not contribute recording is effected regarding said dye ink discharge port, and then said dye ink discharge port face is cleaned by said pigment ink cleaning member or said dye ink cleaning member.

27. A head recovery method for an ink jet recording apparatus having a pigment discharge port for discharging pigment ink and a dye ink discharge port for discharging dye ink, comprising the steps of:

abutting a pigment ink cleaning member against a pigment ink discharge port face in which said pigment ink discharge port is provided to effect cleaning of said face;

abutting a dye ink cleaning member against a dye ink discharge port face in which said dye ink discharge port is provided to effect cleaning of said face;

applying the dye ink discharged from said dye ink discharge port to at least one of said pigment ink cleaning member and said dye ink cleaning member; and cleaning said pigment ink discharge port face by the cleaning member to which the dye ink was applied, wherein, in said applying step, preliminary discharge which does not contribute recording is effected from said dye ink discharge port against said pigment ink cleaning member or said dye ink cleaning member.

* * * * *

UNITED STATES PATENT AND TRADEMARK OFFICE

CERTIFICATE OF CORRECTION

PATENT NO. : 6,663,218 B2
DATED : December 16, 2003
INVENTOR(S) : Uchida

It is certified that error appears in the above-identified patent and that said Letters Patent is hereby corrected as shown below:

Column 1,
Line 25, “made” should read -- be made --.
Line 50, “reliability” should read -- the reliability --.
Line 51, “field” should read -- field, --.
Line 56, “been progressed,” should read -- progressed, --.

Column 3,
Line 55, “the recover” should read -- recover --.

Column 8,
Line 45, “positioned” (second occurrence) should read -- positions --.

Column 9,
Line 46, “characteristic part” should read -- characteristics --.

Column 10,
Line 5, “in cleaned” should read -- is cleaned --.

Column 15,
Line 37, “to the” should read -- the --.
Line 39, “to me” should read -- to be --.
Line 44, “discharged by this preliminary dis-” should be deleted.
Line 45, “charge” should be deleted.

Column 16,
Line 7, “4afor” should read -- 4a for --.
Line 11, “forms” should read -- form --.
Line 38, “heads” should read -- ports --.

UNITED STATES PATENT AND TRADEMARK OFFICE

CERTIFICATE OF CORRECTION

PATENT NO. : 6,663,218 B2
DATED : December 16, 2003
INVENTOR(S) : Uchida

It is certified that error appears in the above-identified patent and that said Letters Patent is hereby corrected as shown below:

Column 17,
Line 16, "an" should be deleted.

Signed and Sealed this

Sixteenth Day of November, 2004

JON W. DUDAS
*Director of the United States Patent and Trademark Office*